US007705784B2

(12) United States Patent
Lai et al.

(10) Patent No.: US 7,705,784 B2
(45) Date of Patent: Apr. 27, 2010

(54) MULTI-FREQUENCY ANTENNA

(75) Inventors: Ying-Jiunn Lai, Taipei Hsien (TW); Jiunn-Ming Huang, Taipei Hsien (TW); Kuan-Hsueh Tseng, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 419 days.

(21) Appl. No.: 11/853,020

(22) Filed: Sep. 11, 2007

(65) Prior Publication Data

US 2008/0136711 A1 Jun. 12, 2008

(30) Foreign Application Priority Data

Dec. 7, 2006 (TW) ..... 95145782 A

(51) Int. Cl.
*H01Q 9/04* (2006.01)

(52) U.S. Cl. ..... 343/700 MS; 343/702; 343/846; 343/848

(58) Field of Classification Search ..... 343/700 MS, 343/702, 846, 848
See application file for complete search history.

(56) References Cited

U.S. PATENT DOCUMENTS 6,515,630 B2 * 2/2003 Honda ..... 343/702
6,535,166 B1 * 3/2003 Ali ..... 343/700 MS
7,042,404 B2 * 5/2006 Jo et al. ..... 343/702

* cited by examiner

*Primary Examiner*—Douglas W Owens
*Assistant Examiner*—Chuc D Tran
(74) *Attorney, Agent, or Firm*—Pai Patent & Trademark Law Firm; Chao-Chang David Pai

(57) ABSTRACT

A multi-frequency antenna for receiving a first frequency and second frequency signals comprises a grounding element, a first conductive member, a first radiation member, and a second radiation member. The first conductive member connects to the grounding element. The first radiation member and the second radiation member connect to the first conductive member separately. The multi-frequency antenna further comprises a parasitic structure. The parasitic structure structurally encircles the second radiation member and the encirclement is a partial encirclement. Moreover, the parasitic structure connects to the grounding element.

30 Claims, 18 Drawing Sheets

MULTI-FREQUENCY ANTENNA

RELATED APPLICATIONS

This application claims priority to Taiwan Application Serial Number 95145782, filed Dec. 7, 2006, which is herein incorporated by reference.

BACKGROUND OF THE INVENTION

1. Field of Invention

The invention relates to an antenna structure and, in particular, to a multi-frequency antenna structure.

2. Related Art

The connections and communications among various wireless networks, such as wireless personal area networks (WPAN), wireless local area networks (WLAN), and wireless wide area networks (WWAN), or system devices can be implemented with the antennas therein.

Generally speaking the antennas of wireless devices can be external or internal. For example, the external antennas of some laptop computers are disposed at the top of the monitors or on the PCMCIA cards. Such external antennas have higher costs because they are exposed to the environment and more susceptible to damages. The other design is to embed antennas inside the laptop computers.

The internal antenna designs can avoid drawbacks of external antennas. For example, the computer device can have a better appearance. The antenna is also prevented from accidental damages. However, building the antenna inside a spatially limited computer device may have bad effects on its efficiency. Therefore, the internal antennas have to be appropriately designed in order to fit the space inside the portable computer device and to provide a sufficient efficiency.

SUMMARY OF THE INVENTION

An objective of the invention is to provide a multi-frequency antenna for wireless devices such as the laptop computer to transmit and receive wireless signals within limited space.

In accord with the above-mentioned objective, the invention provides a multi-frequency antenna for receiving signals of a first frequency and a second frequency. The multi-frequency antenna has a grounding element, a first conductive member, a first radiation member, and a second radiation member. The first conductive member has a conductive component and a ground connecting component. One edge of the ground connecting component connects to the conductive component perpendicularly, and its other side connects to the grounding element. The first radiation member receives the first-frequency signal, and connects to the conductive component. The second radiation member receives the second-frequency signal, and connects to the conducive component at a predetermined distance from the first radiation member. The first radiation member is partially disposed between the grounding element and the second radiation member.

The multi-frequency antenna is disposed in a three-dimensional space with a first surface, a second surface, a third surface, and a fourth surface. The second surface is roughly perpendicular to the first surface. The third surface is roughly parallel to the second surface, and perpendicular to the first surface. The fourth surface is roughly parallel to the first surface, and roughly perpendicular to the second and third surfaces. The multi-frequency antenna includes a grounding element, a first conductive member, a first radiation member, and a second radiation member. The grounding element is disposed on the first surface. The first conductive member has a conductive component and a ground connecting component. The ground connecting component is disposed on the second surface, with one edge connected to the conductive component and the other edge connected to the grounding element. The first radiation member receives signals of the first frequency and connects to the conductive component. The first radiation member distributes over the second surface and the third surface. The second radiation member receives signals of the second frequency and connects to the conductive component at a predetermined distance from the first radiation member. The second radiation member is disposed on the second, third, and fourth surfaces. The multi-frequency antenna is further installed with a passive element and a parasitic structure to increase the frequency response of the first and second radiation members.

Therefore, the disclosed multi-frequency antenna can provide good wireless signal transmission and reception efficiency even in a limited space of a portable computer device.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

An embodiment of the invention is a multi-frequency antenna disposed in a portable electronic device with the wireless communication function, such as a laptop computer or a personal digital assistant (PDA). Such a multi-frequency antenna can receive signals in at least two frequency bands. For the convenience of description, this specification refers exclusively to their central frequencies unless specified. That is, the specification uses a first frequency and a second frequency to represent the two bands. Any person skilled in the art can vary different parameters in the antenna design for different applications according to the need.

Figure 1:
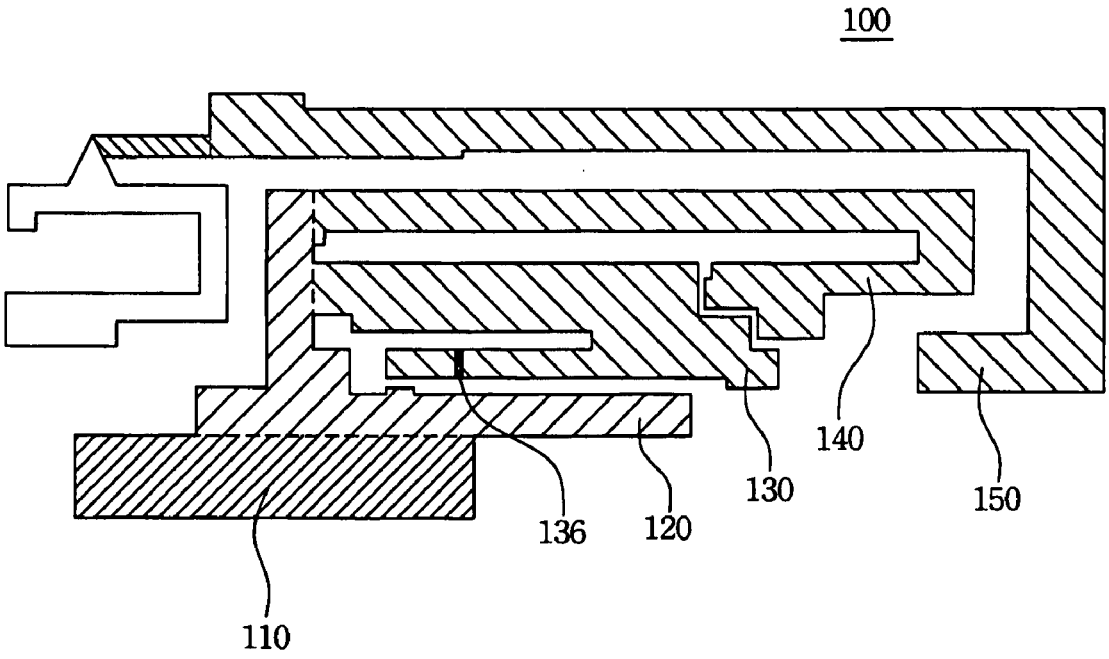
FIG. 1 is an expanded planar view of the multi-frequency antenna according to an embodiment of the invention.

A planar view of the multi-frequency antenna according to an embodiment of the invention is shown in FIG. 1. In this embodiment, the multi-frequency antenna 100 has a grounding element 110, a first conductive member 120, a first radiation member 130, and a second radiation member 140. The first radiation member 130 receives signals of the first frequency, and the second radiation member 140 receives signals of the second frequency. To increase the frequency response of the first conductive member 120 and the second radiation member 140, a passive element 136 and a parasitic structure 150 are further disposed on the multi-frequency antenna 100. The connecting relations and detailed structures of various parts of the invention are given in FIGS. 2A to 2E. These figures are planar views of various parts of the multi-frequency antenna. Certain parts are not described and labeled with numerals to avoid complications.

Figure 2A:
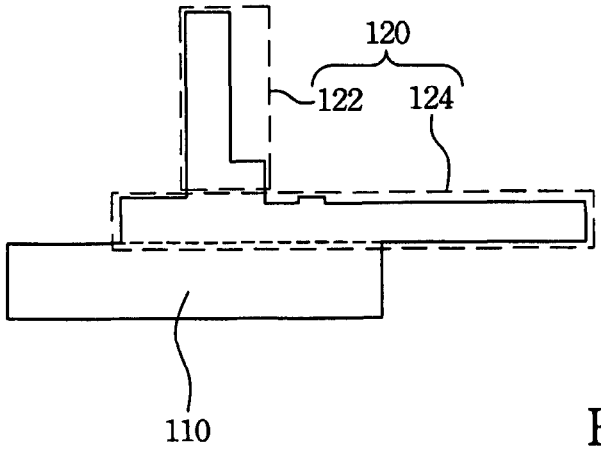
FIGS. 2A to 2E are planar exploded views of various parts of the multi-frequency antenna.

In FIG. 2A, the first conductive member 120 has a conductive component 122 and a ground connecting component 124. The ground connecting component 124 perpendicularly connects to the conductive component 122 with one edge and to the grounding element 110 with the other edge.

Figure 2B:
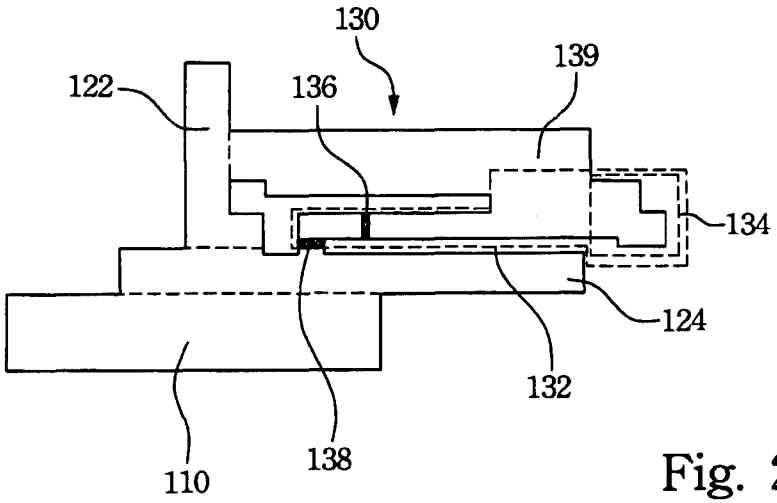

FIG. 2B describes the structure of the first radiation member 130. The first radiation member 130 receives signals of the first frequency, and connects to the conductive component 122. The first radiation member 130 has a first radiation body 139 and a first connecting part 132. The first radiation body 139 connects to the conductive component 122. One end of the first connecting part 132 is connected to the conductive component 124 via a first connecting point 138. The other end of the first connecting part 132 has a ladder-shaped structure 134.

Besides, the first radiation member 130 further includes a passive element 136 to increase the frequency matching of the first radiation member 130. The passive element 136 is disposed on the first connecting part 132. However, whether the passive element 136 should be installed on the multi-frequency antenna 100 is determined by the working bands of the antenna.

Figure 2C:
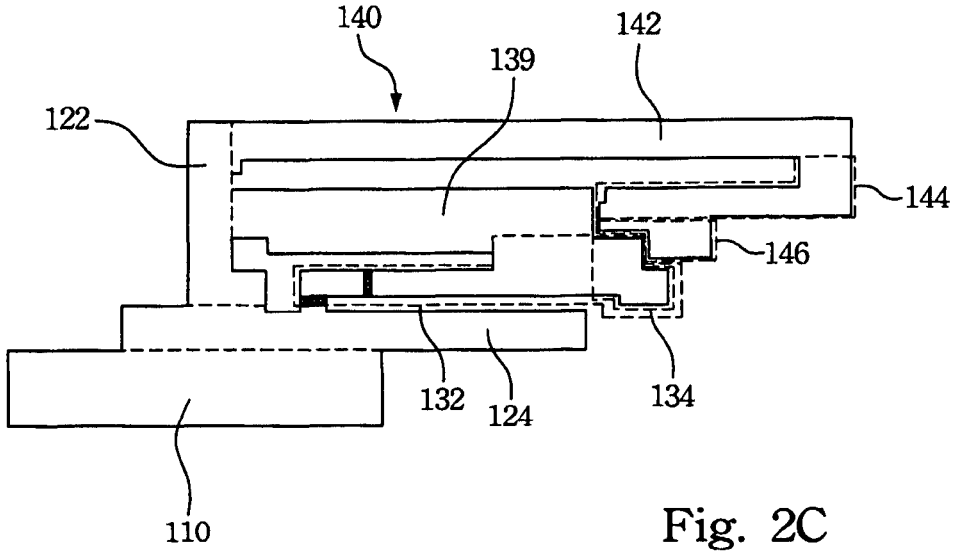

With reference to FIG. 2C, the second radiation member 140 has a second radiation body 142 connected with the conductive component 122. The second radiation member 140 further includes an L-shaped extension 144 connected with the second radiation body 142 and extending from the second radiation body 142 to the first radiation body 139. The L-shaped extension 144 further includes a first extension 146 extending toward the ladder-shaped structure 134 with a shape corresponding to that of the ladder-shaped structure but not touching the ladder-shaped structure 134. That is, the first extension 146 and the ladder-shaped structure 134 are separate.

Figure 2D:
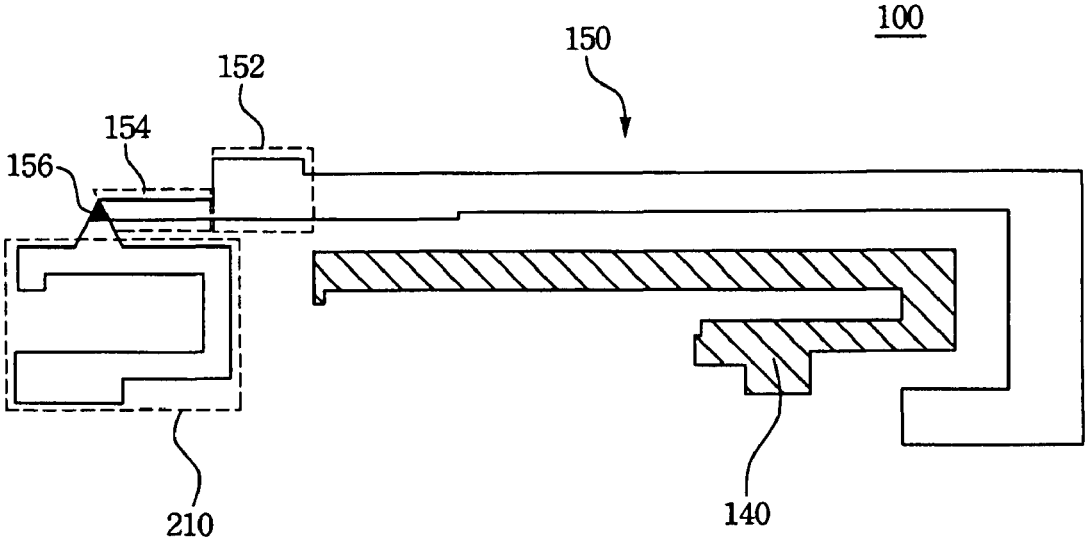

FIG. 2D shows the appearance of the parasitic structure 150. The parasitic structure 150 is designed to increase the frequency response of the second radiation member 140. Therefore, whether it should be installed on the multi-frequency antenna 100 depends upon the need. The shape of the parasitic structure 150 corresponds to that of the second radiation member 140. The parasitic structure 150 and the second radiation member 140 are separate. One end of the parasitic structure 150 has a ground connecting part 152 connected with the grounding element 110. It will be further described later. In this embodiment, the parasitic structure 150 has a shape encircling the second radiation member 140 to increase the frequency response thereof. In other embodiments, it is also designed according to the shape of the second radiation member 140.

Figure 2E:
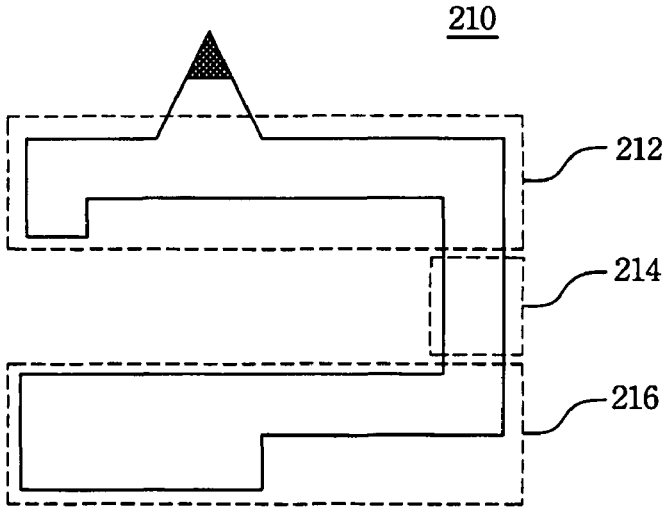

Furthermore, the multi-frequency antenna in this embodiment can be installed with a third radiation member 210 to increase the applicable wireless standard of the multi-frequency antenna. Therefore, the ground connecting part 152 of the parasitic structure 150 further extends out a second conductive member 154. The third radiation member 210 connects to the second conductive member 154 via a second connecting point 156. In other words, the third radiation member 210 of the multi-frequency antenna connects to the parasitic structure 150. The structure of the third radiation member 210 is shown in FIG. 2E. In this embodiment, the third radiation member 210 includes a first portion 212 and a second portion 216. The first portion 212 and the second portion 216 receive signals of a third frequency and a fourth frequency, respectively. The first portion 212 and the second portion 216 are connected via a third conductive member 214. The third radiation member 210 can have different shapes in accord with different wireless standards in other embodiments.

Figure 3:
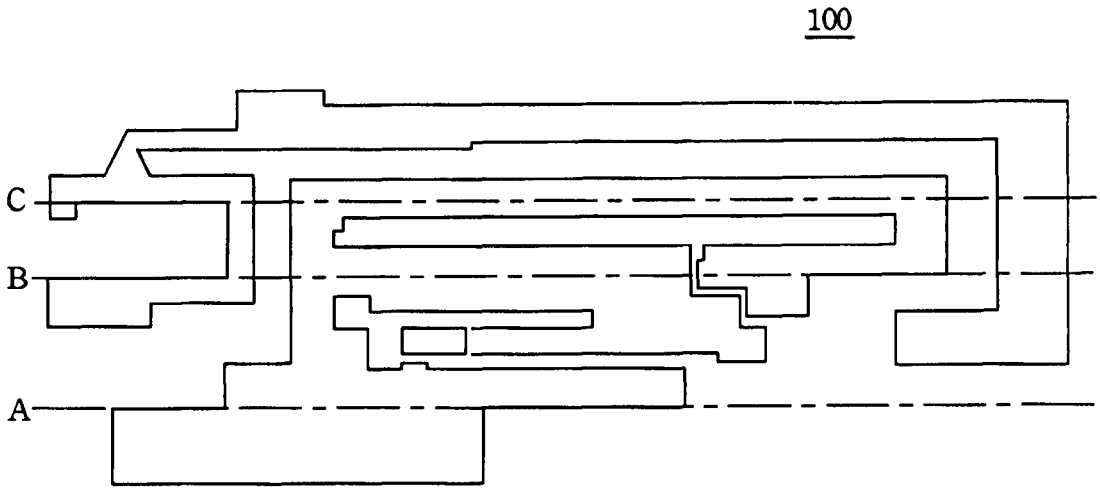
FIG. 3 is a schematic view of the lines for bending the antenna planar structure according to the embodiment.

In practice, the multi-frequency antenna in this embodiment is disposed in a three-dimensional space inside a wireless device. Therefore, the above-mentioned structure bends along some specific line. Please refer to FIG. 3 showing the antenna structure bending along a line. The multi-frequency antenna structure in this embodiment bends along three lines A, B, and C to form a three-dimensional structure.

Figure 4A:
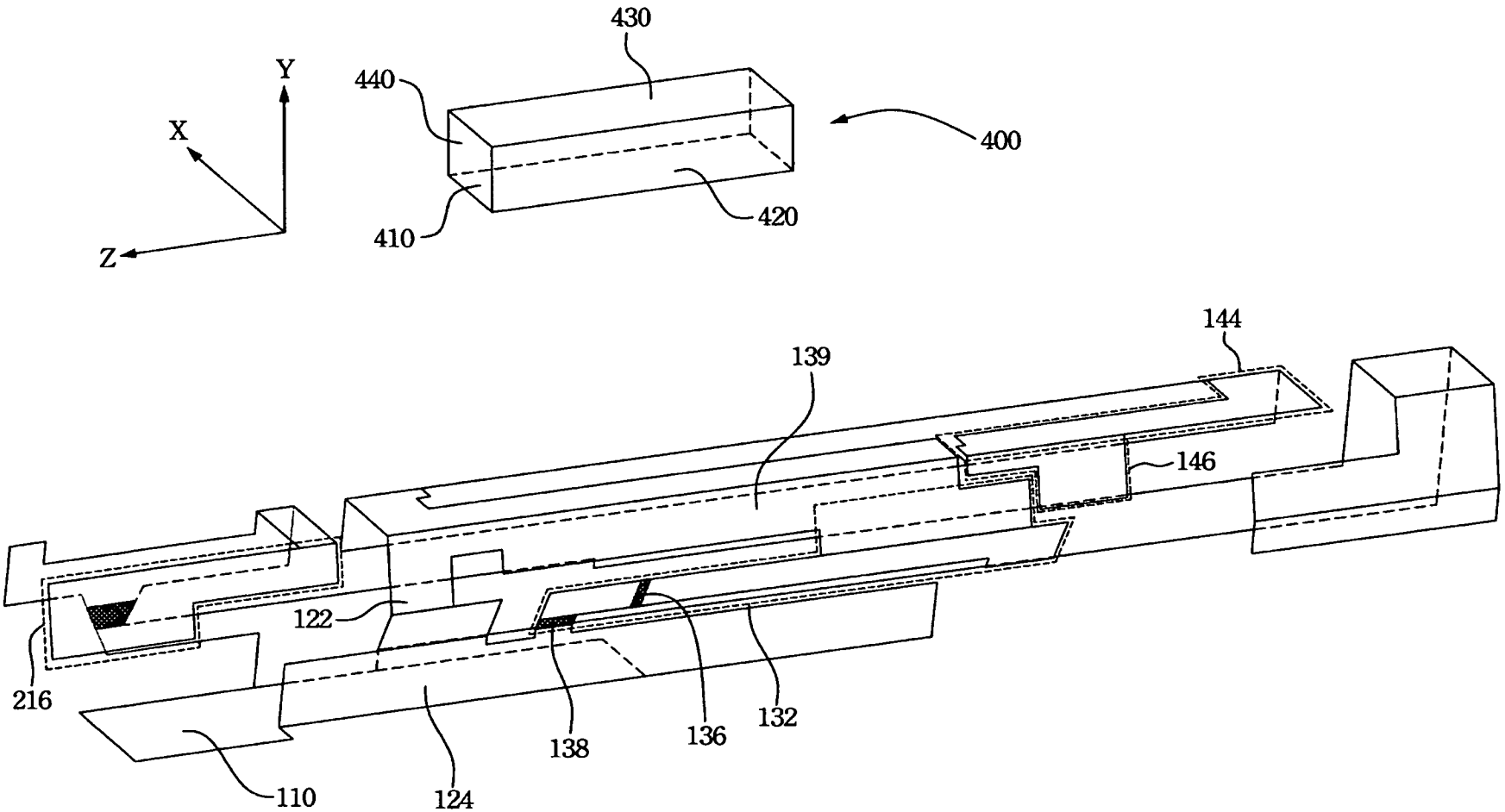
FIGS. 4A to 4D are three-dimensional views of the multi-frequency antenna from different perspective angles.
Figure 4B:
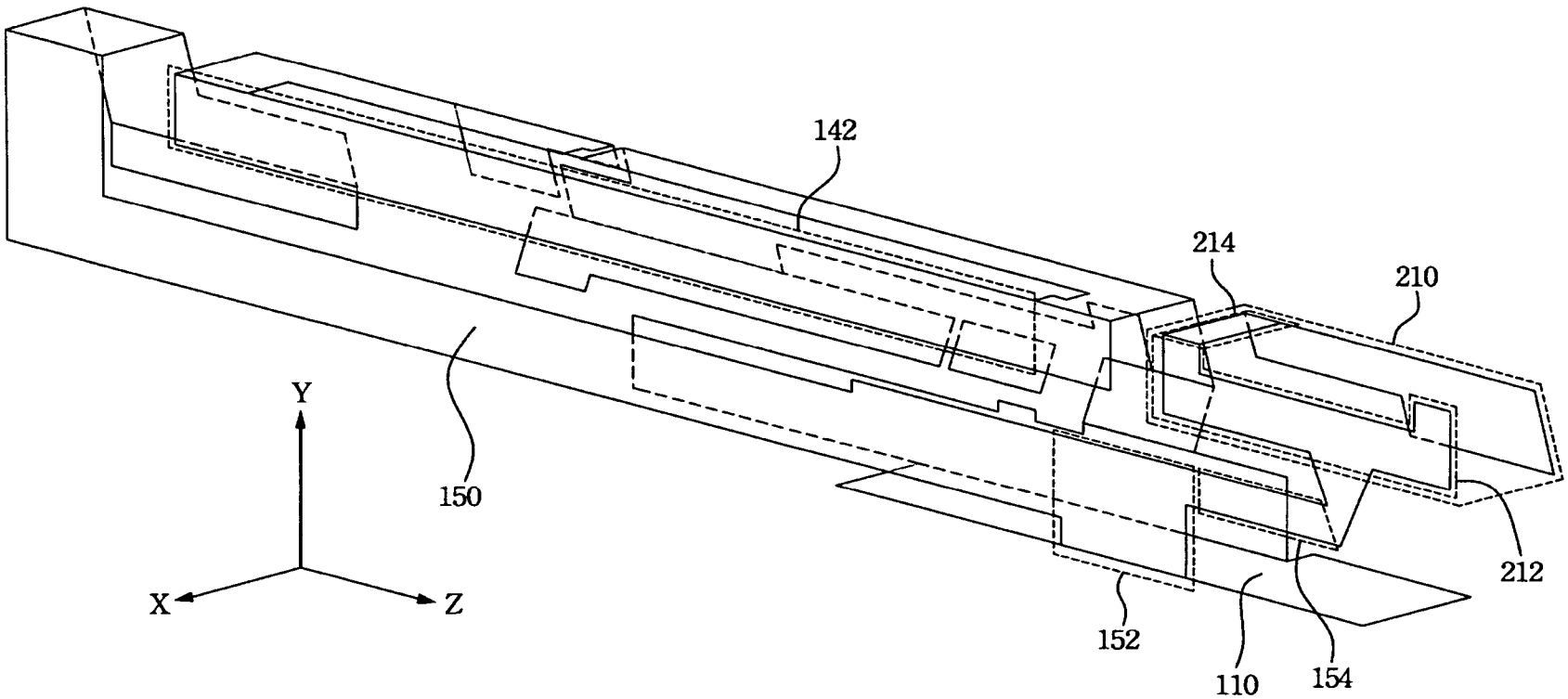
Figure 4C:
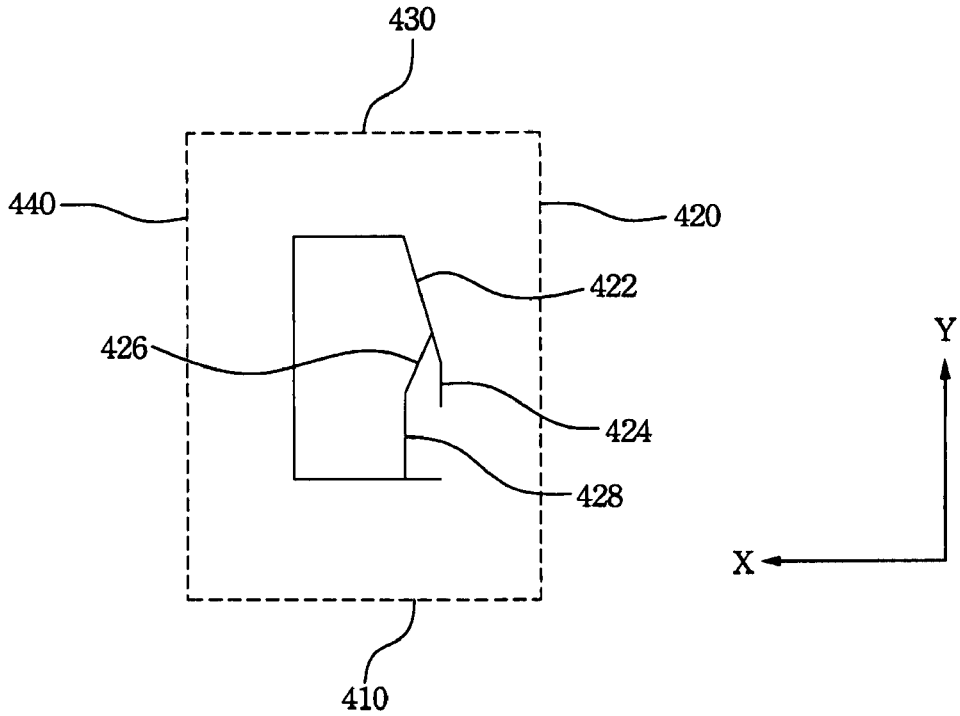
Figure 4D:
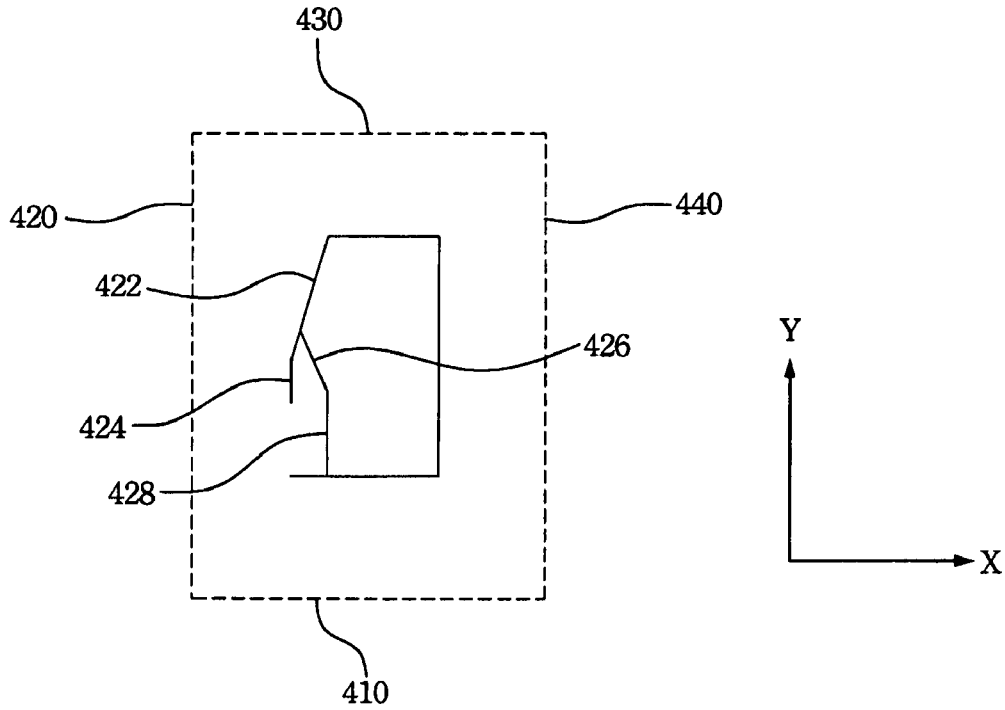

Please refer to FIGS. 4A to 4D, showing the multi-frequency antenna of this embodiment in different perspective angles. FIGS. 4A and 4B are three-dimensional views from different angles. FIGS. 4C and 4D are side views of both ends of the antenna. FIG. 4A shows the multi-frequency antenna after it bends along the three lines.

The three-dimensional space of the multi-frequency antenna has four surfaces, a first surface 410, a second surface 420, a third surface 430, and a fourth surface 440. The second surface 420 is perpendicular to the first surface 410. The third surface 430 is parallel to the second surface 420 and perpendicular to the first surface 410. The fourth surface 440 is parallel to the first surface 410 and perpendicular to the second surface 420 and the third surface 430. As FIGS. 4A to 4D are for different viewing angles, the specification uses the X, Y, and Z axes to define the four surfaces. The negative Y axis points to the first surface 410. The positive Y axis points to the third surface 430. The negative X axis points to the first surface 420. The positive X axis points to the fourth surface 440. Since the connecting relations of various components in the antenna have been described before, they are not repeated hereinafter.

FIGS. 4A and 4B show how various components are distributed in the three-dimensional structure of the antenna. The grounding element 110 is disposed on the first surface 410. The first conductive member 120 distributes over the second surface 420, the third surface 430, and the fourth surface 440. The first connecting part 132 exists on the second surface 420. The first radiation body 139 distributes over the second surface 420 and the third surface 430.

Figure 5:
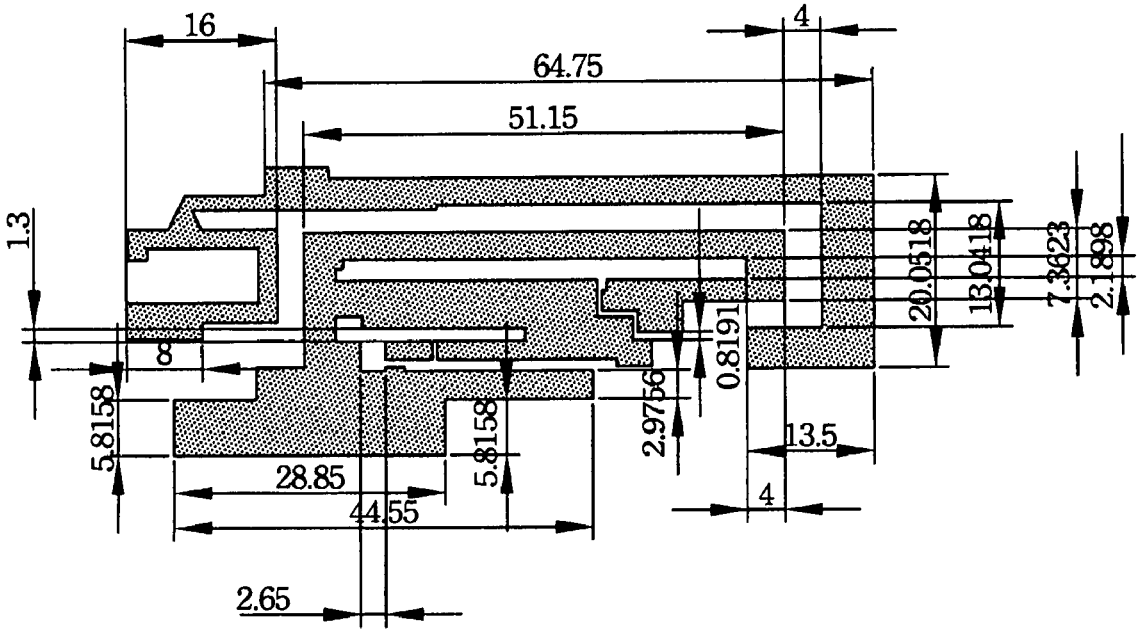
FIG. 5 shows the sizes of various parts of the multi-frequency antenna.

The second radiation body 142 and the parasitic structure 150 are located on the fourth surface 440. The second conductive member 154 exists on the fourth surface 440. The parasitic structure 150 extends via the third surface 430 to the second surface to increase the frequency response of the second radiation member 140. FIG. 5 shows that the ground connecting part 152 and the grounding element 110 are connected in the three-dimensional space, so that the entire antenna structure has all the fourth surfaces connected.

The first portion 212 of the third radiation member 210 is also located on the fourth surface 440. The third conductive member 214 is located on the third surface 430. The second portion 216 is located on the second surface 420. The first portion 212 and the second portion 216 are connected via the third conductive member 214.

The L-shaped extension 144 is located on the third surface 430, extending from the second radiation body 142 toward the first radiation body 139. The first extension 146 extended from the L-shaped extension 144 is located on the second surface 420.

As shown in FIGS. 4C and 4D, the components on the second surface 420 are not disposed on the same plane. It consists of surfaces 422, 424, 426, and 428. Please refer simultaneously to FIG. 4A. Surface 428 is a ground connecting component 124. Surface 426 has the conductive component 122 and the first connecting part 132. Surface 422 includes the second portion 216, the first radiation body 139, the first extension 146, the first connecting part 132, and the parasitic structure 150. The parasitic structure 150 extends to part of the first surface, but does not bend to reach surface 426. It bends at a different position to produce surface 424.

To fully understand the functions of the disclosed multi-frequency antenna, this embodiment is applied to the working bands of a wireless wide area network (WWAN). The working bands of the WWAN are about 824~960 MHz and 1710~2170 MHz. The sizes of various components of the antenna are shown in FIG. 5 in units of millimeters (mm). The drawing also shows the voltage standing wave ratio (VSWR) and efficiency of the antenna. In the VSWR plot, the horizontal axis is the frequency and the vertical axis is the return loss. In particular, point A has a frequency of 824 MHz, point B has a frequency of 960 MHZ, point C has a frequency of 1710 MHz, and point D has a frequency of 2170 MHz. The antenna efficiency plot has the frequency as its horizontal axis and the efficiency as its vertical axis. According to the VSWR plot, the return loss of the antenna in the WWAN working bands is expected to be lower than 2, ensuring a good impedance matching.

Figure 6:
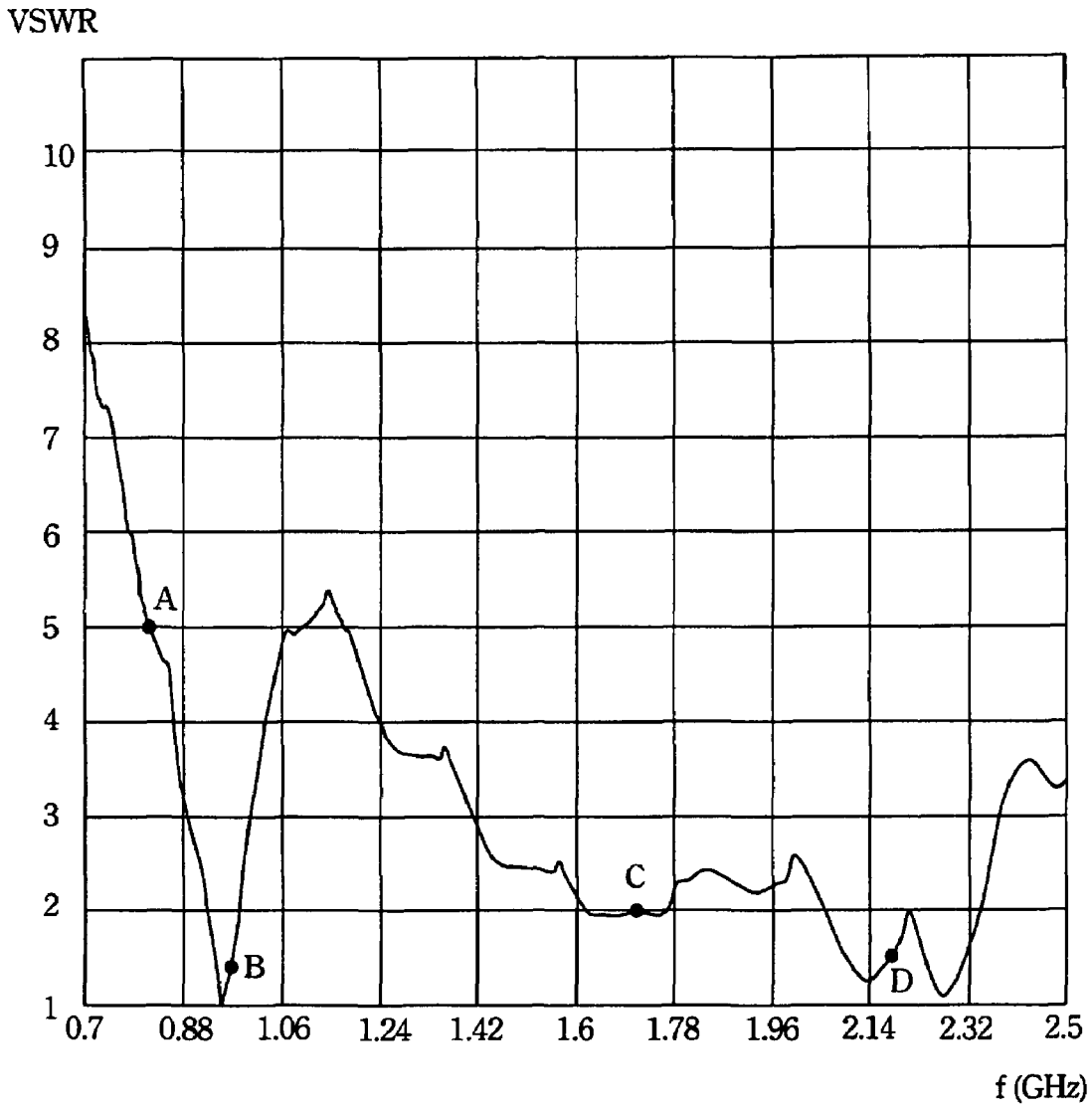
FIG. 6 shows the VSWR of the multi-frequency antenna before the installation of the passive element and the parasitic structure.
Figure 7:
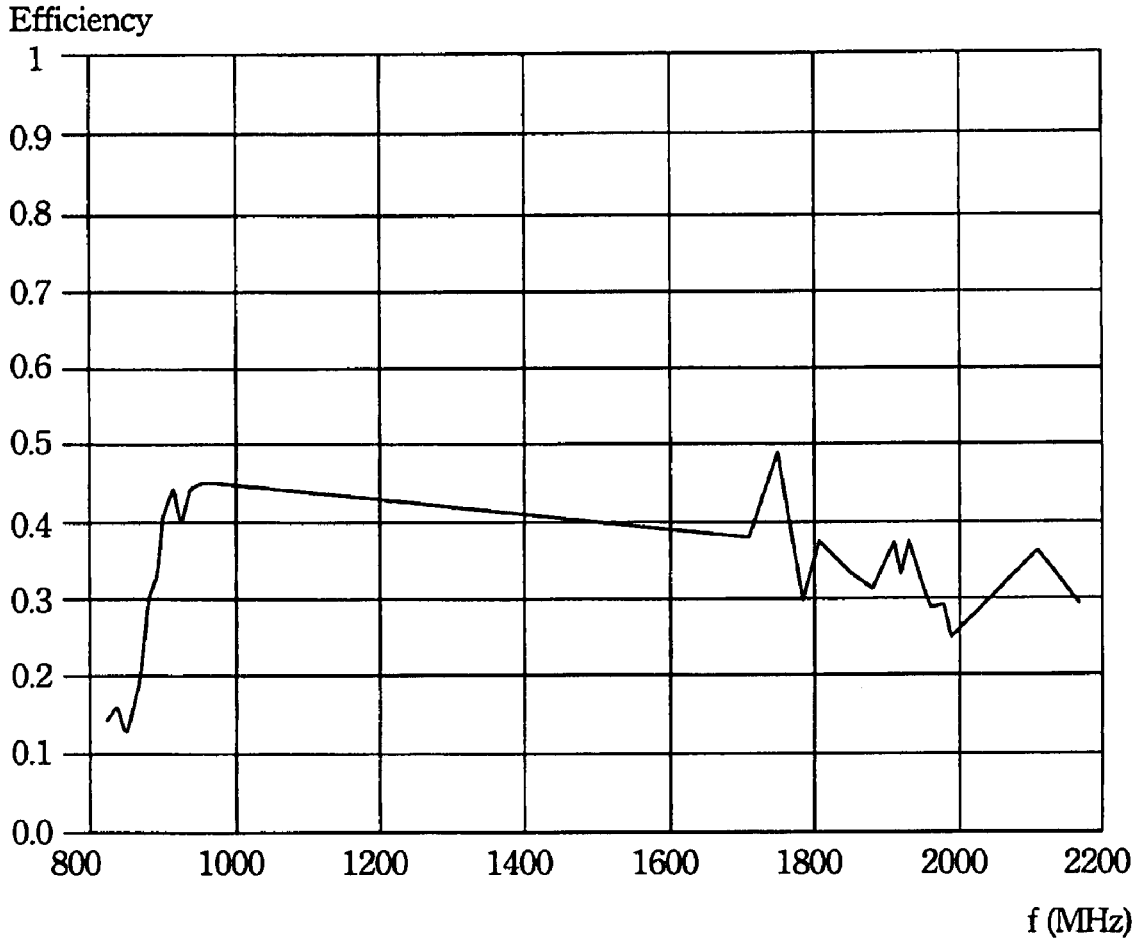
FIG. 7 shows the antenna efficiency of the multi-frequency antenna before the installation of the passive element and the parasitic structure.

Please refer to FIGS. 6 and 7. FIG. 6 shows the VSWR when the multi-frequency antenna does not have the passive element and the parasitic structure. FIG. 7 shows the antenna efficiency of the same. Most of the return loss between point A and point B is above 2. The situation is the same between point C and point D. In FIG. 7, the working efficiencies of the antenna in the frequency bands 824~960 MHz and 1710~2170 MHz are not very high. This means that the disclosed multi-frequency antenna can still work even without the passive element and the parasitic structure. However, it can be improved in the working bands of the WWAN.

Figure 8:
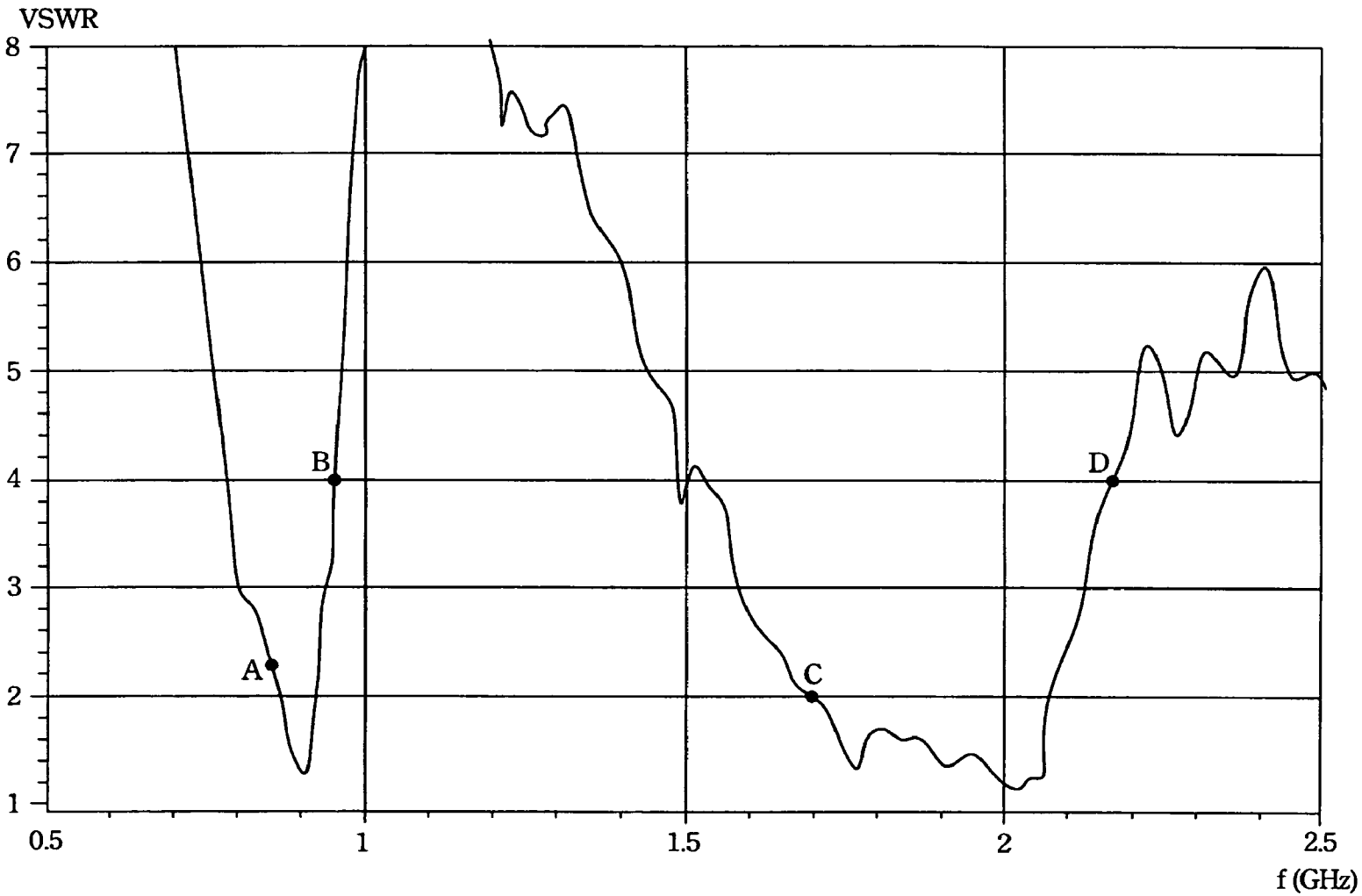
FIG. 8 shows the VSWR of the multi-frequency antenna after the installation of the passive element but not the parasitic structure.
Figure 9:
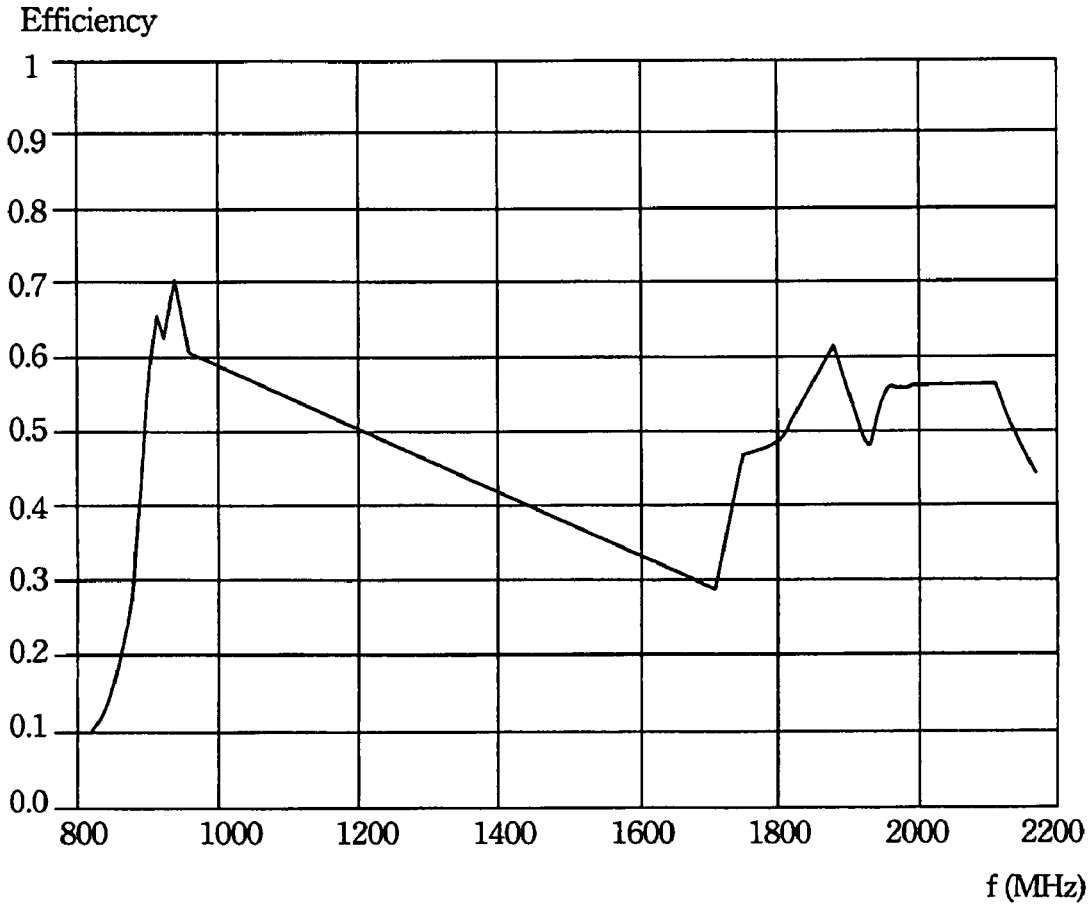
FIG. 9 shows the antenna efficiency of the multi-frequency antenna after the installation of the passive element but not the parasitic structure.

To increase the frequency response of the antenna at high frequencies, the first connecting part is connected with a passive element, such as a capacitive passive element, inductive passive element, or resistive passive element. FIGS. 8 and 9 show the VSWR and the antenna efficiency after the passive element is installed. As shown in FIG. 8, the return loss in most of the band between point C and point D is lower than 2. However, the low-frequency response between point A and point B is still inappropriate for applications in WWAN. FIG. 9 shows that the antenna efficiency in the two bands has a significant improvement.

Figure 10:
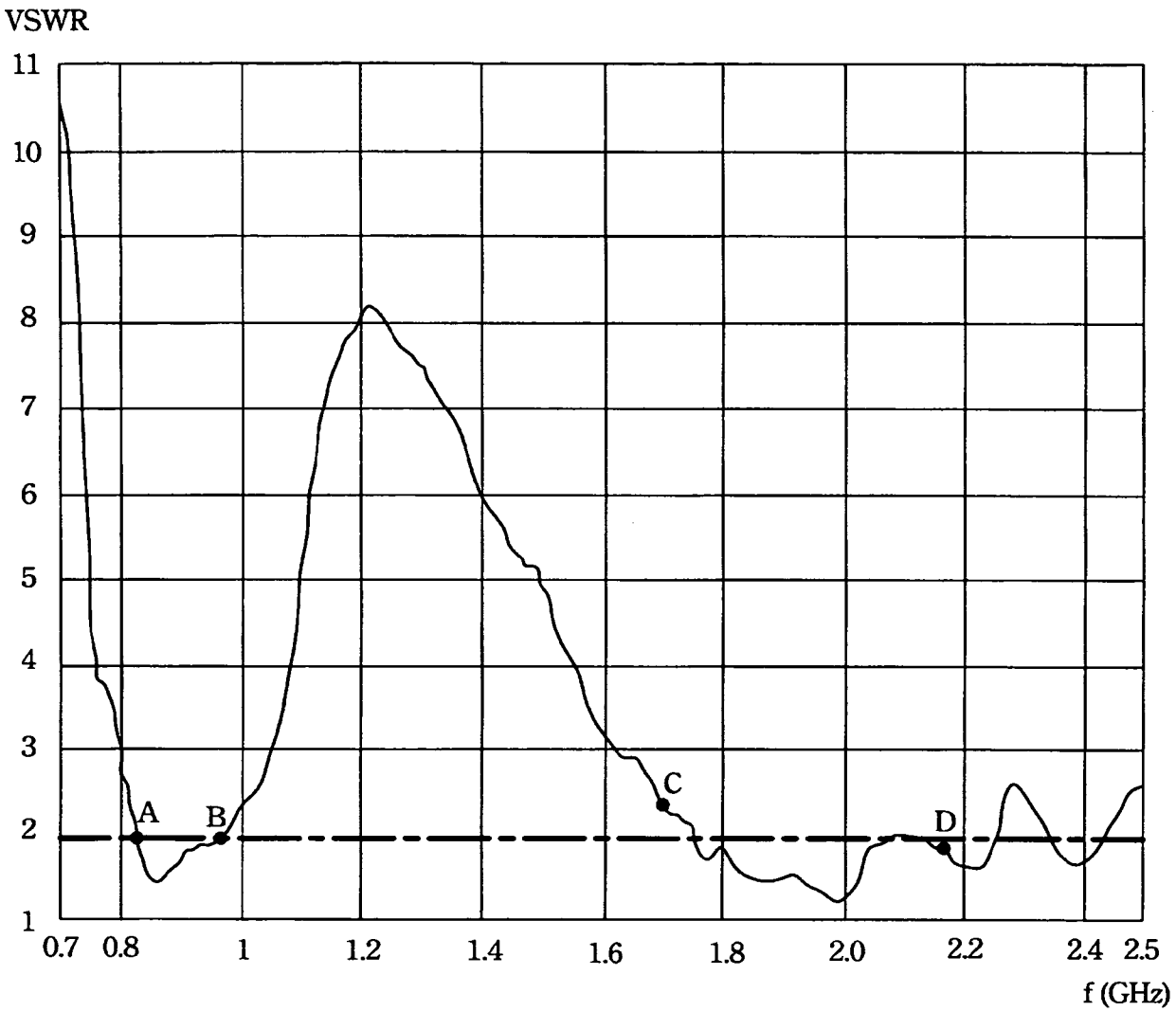
FIG. 10 shows the VSWR of the multi-frequency antenna after the installation of the passive element and the parasitic structure.
Figure 11:
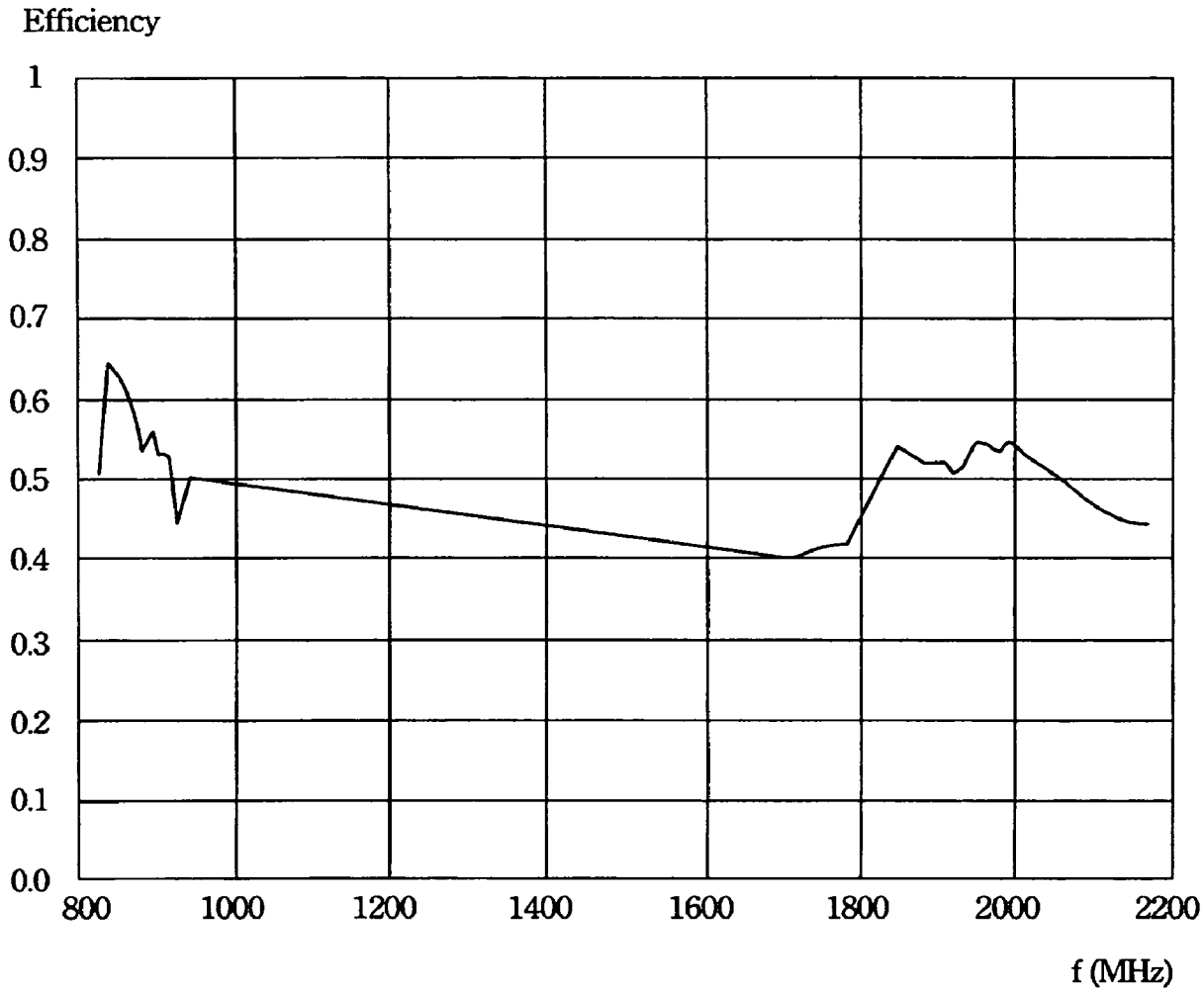
FIG. 11 shows the antenna efficiency of the multi-frequency antenna after the installation of the passive element and the parasitic structure.

To further enhance the frequency response of the antenna at low frequencies, a parasitic structure is provided in the antenna, extending from the grounding element and encircling the second radiation member. FIG. 10 gives the result of the VSWR of the antenna. FIG. 11 shows the antenna efficiency in this case. The frequency response in either high or low frequencies is almost all below 2. Therefore, the antenna is suitable for WWAN applications after the installation of passive element and parasitic structure. As shown in FIG. 11, the antenna has good efficiencies in the two bands used for the WWAN.

Figure 12:
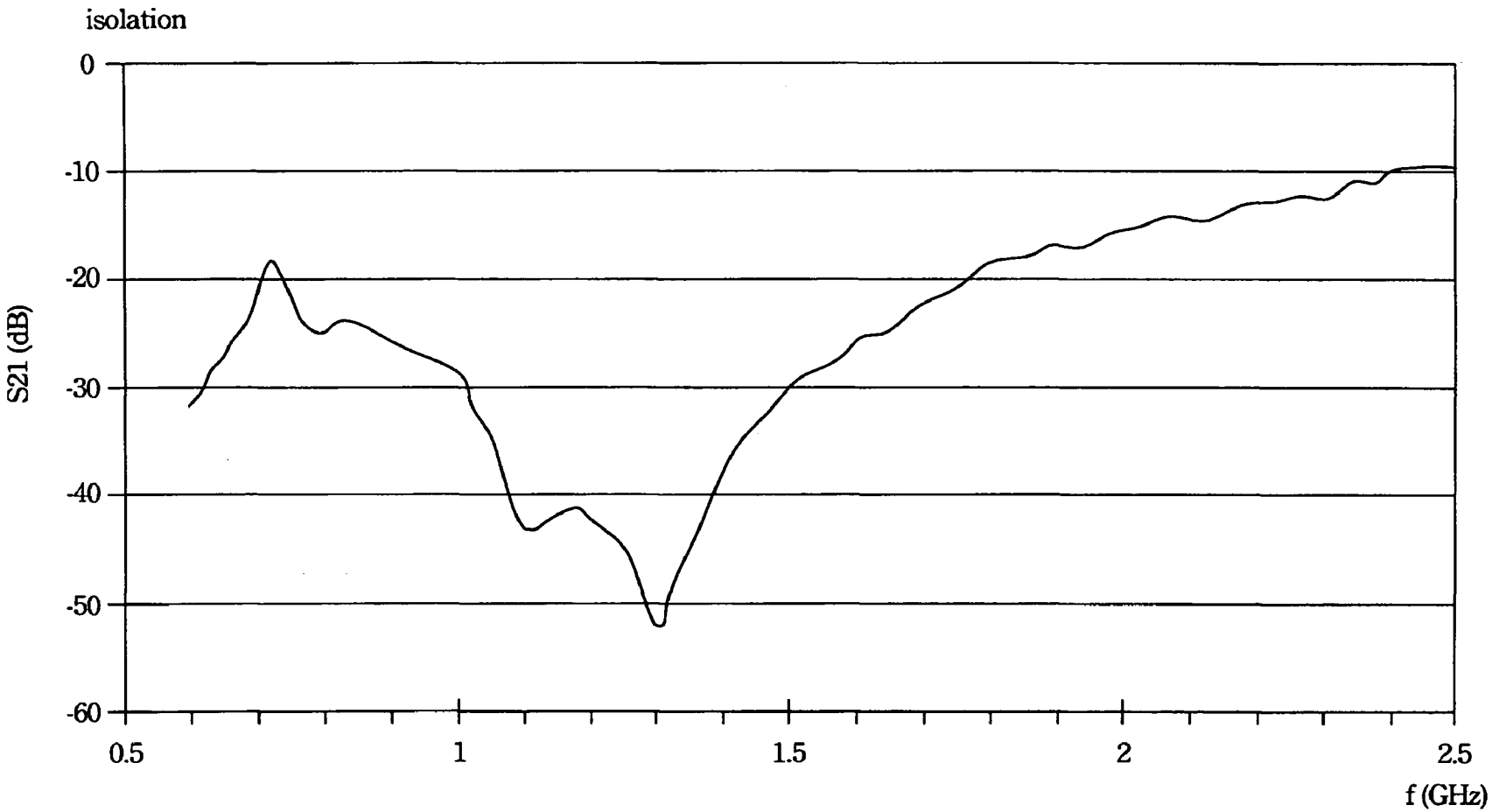
FIG. 12 shows the measured result of the S21 parameter in the band of 0.8 GHZ to 2.5 GHz
Figure 13:
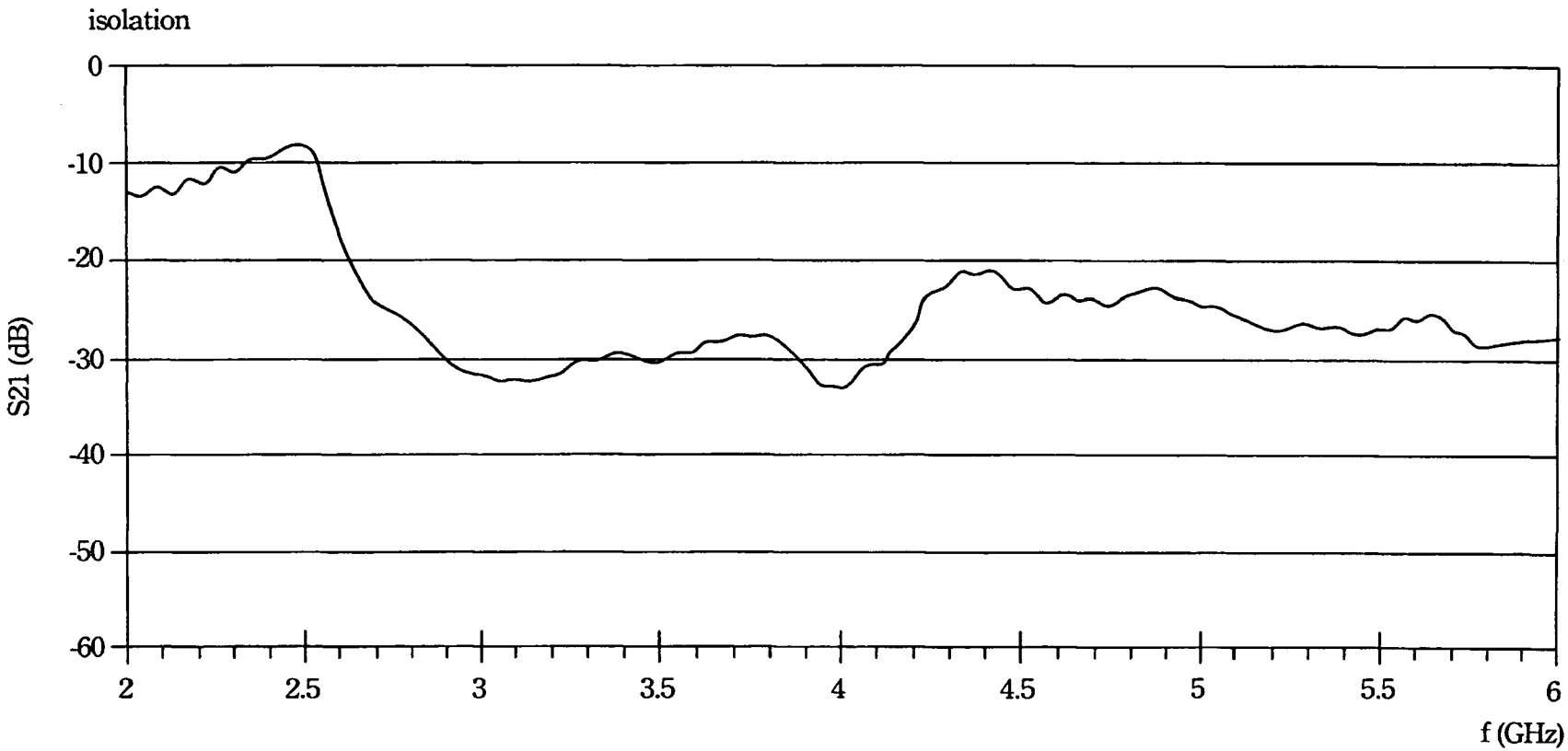
FIG. 13 shows the measured result of the S21 parameter in the band of 2 GHZ to 6 GHz.

In addition to the first radiation member and the second radiation member, the multi-frequency antenna in this embodiment is further provided with a third conducive member connected to one end of the parasitic structure. When the antenna is used in a WWAN, the first radiation member and the second radiation member receive signals in high and low frequencies. In this embodiment, the third conductive member uses the design of the first portion and the second portion to receive signals of the wireless area network (WAN). Nevertheless, there should be sufficient separation between the antennas for the WWAN and the WAN in order to ensure the normal operations of the two antennas. FIGS. 12 and 13 provide the measured result of the parameter S21 of the antenna. The vertical axis indicates the S21 parameter in units of dB. The horizontal axis is the frequency. The drawing shows that, with the installation of the WAN antenna in the disclosed multi-frequency antenna, S21 in the band of 0.8~1 GMHZ is mostly below −20 dB, meaning that the separation in this band is mostly smaller than −20 dB. S21 in the band of 1 G~6 is mostly below −10 dB, meaning that the separation in this band is mostly smaller than −10 dB. Therefore, the two antennas for the WWAN and the WAN have a good separation.

Of course, in addition to being used as the WAN antenna, the third radiation member in other embodiments can be used for other wireless communication protocol by tuning its parameters and shape. Such wireless communication protocols include Ultra-wideband (UWB), worldwide Interoperability for Microwave Access (Wi-MAX), and Digital Video Broadcasting.

Figure 14:
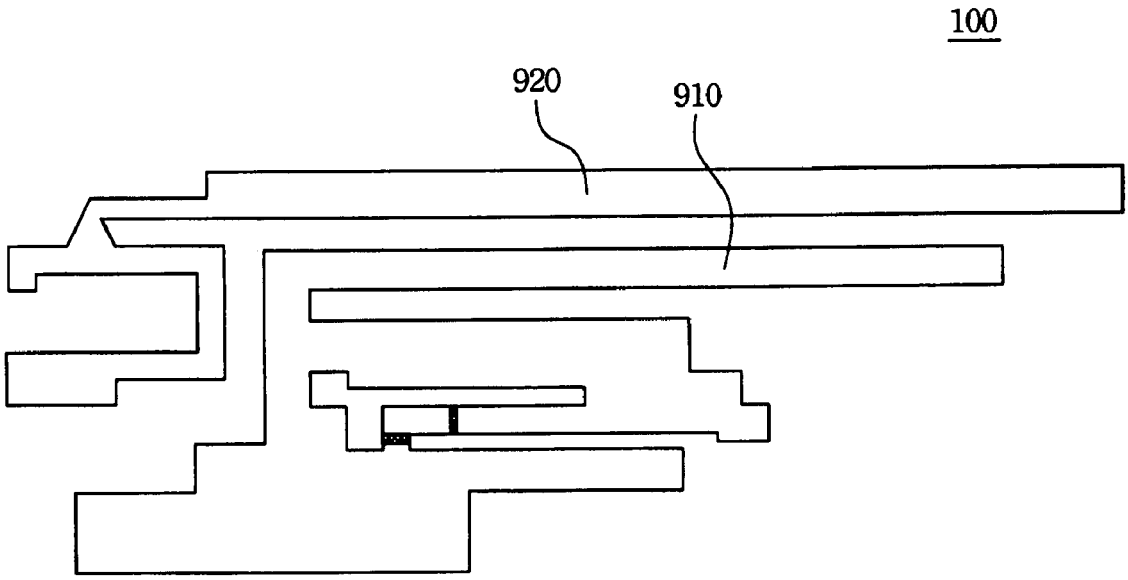
FIG. 14 is an expanded planar view of the multi-frequency antenna according to another embodiment of the invention.
Figure 15:
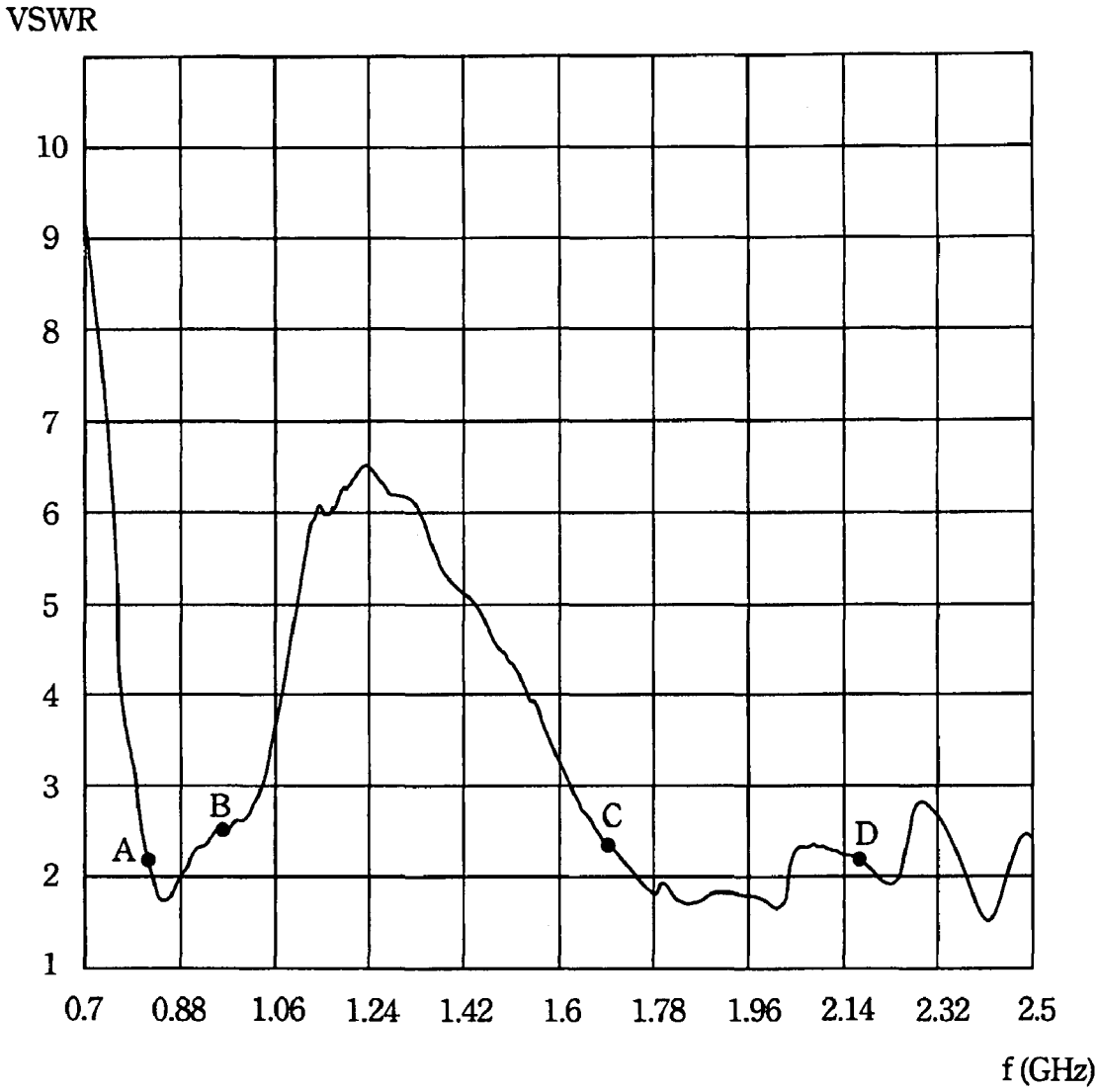
FIG. 15 shows the VSWR of the multi-frequency antenna of FIG. 14.

Besides, the invention can have another embodiment. FIG. 14 is a planar view of the antenna structure. In this embodiment, the second radiation member 910 and the parasitic structure 920 are changed into a long-stripe structure. Other components are the same as the previously mentioned embodiment. A passive element is also installed to increase the frequency response of the first radiation member. After the antenna is bent according to the bending lines mentioned before, its VSWR is shown in FIG. 15. The VSWR of the antenna in certain bands can go below 2.5. Although its efficiency is not as good as the embodiment of FIG. 1, it can nevertheless be used as an antenna for other bands or be improved for better impedance matching in specific bands by varying its parameters.

In all embodiments of the invention, the first connecting point is the signal feeding point of the first radiation member and the second radiation member. The second connecting point is the signal feeding point of the third radiation member. Besides, the disclosed multi-frequency antenna can be made of a thin metal or a soft printed circuit. A plastic solid can be disposed in the central region of the three-dimensional structure for better structural support.

The multi-frequency antenna structure of the invention can provide wireless signal transmission and reception within limited space inside a wireless device. The parasitic structure and the passive element are employed to increase the frequency matching of the radiation members. A subsidiary antenna structure can be further attached to the parasitic structure, so that the multi-frequency antenna has wider applications. With the installation of parasitic structure and passive element of appropriate sizes, experiments indicate that the disclosed multi-frequency antenna have good performance in the working bands of the WWAN.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A multi-frequency antenna for receiving signals of a first frequency and a second frequency, the multi-frequency antenna comprising:

a grounding element;

a first conductive member having a conductive component and a ground connecting component, a first edge of the ground connecting component perpendicularly connecting to the conductive component and a second edge of the ground connecting component connecting to the grounding element;

a first radiation member connecting to the conductive component; and a second radiation member connecting to the conductive component at a predetermined distance from the first radiation member;

wherein the first radiation member is partially disposed between the grounding element and the second radiation member.

2. The multi-frequency antenna of claim 1, wherein the first radiation member includes a first radiation body and a first connecting part, the first radiation body connecting to the conductive component, one end of the first connecting part connecting to the ground connecting component via a first connecting point, and the other end of the first connecting part having a ladder-shaped structure.

3. The multi-frequency antenna of claim 2, wherein the first connecting point is the signal feeding point of the first radiation member and the second radiation member.

4. The multi-frequency antenna of claim 2, wherein the second radiation member has a second radiation body connecting to the conductive component.

5. The multi-frequency antenna of claim 4, wherein the second radiation member further includes an L-shaped extension extending from the second radiation body to the first radiation body, the L-shaped extension having a first extension extending toward the ladder-shaped structure and a shape corresponding to that of the ladder-shaped structure, and the first extension and the ladder-shaped structure being separate.

6. The multi-frequency antenna of claim 1 further comprising a passive element, wherein the first radiation member includes a first radiation body and a first connecting part, the first radiation body connecting to the conducive component, one end of the first connecting part connecting to the ground connecting component via a first connecting point, and the passive element being disposed on the first connecting part.

7. The multi-frequency antenna of claim 1 further comprising a parasitic structure having a shape corresponding to that of the second radiation member and separated from the second radiation member.

8. The multi-frequency antenna of claim 7, wherein the parasitic structure has a ground connecting part connecting to the grounding element.

9. The multi-frequency antenna of claim 8, wherein the ground connecting part further includes a second conducive member extending out from the ground connecting part.

10. The multi-frequency antenna of claim 9 further comprising a third radiation member connecting to the second conductive member via a second connecting point.

11. The multi-frequency antenna of claim 10, wherein the second connecting point is the signal feeding point of the third radiation member.

12. The multi-frequency antenna of claim 11, wherein the third radiation member further includes a first portion for receiving signals of a third frequency.

13. The multi-frequency antenna of claim 12, wherein the third radiation member further includes a second portion connected with the first portion via a third conductive member.

14. The multi-frequency antenna of claim 1 made of a metal material.

15. The multi-frequency antenna of claim 1 made of a soft printed circuit.

16. A multi-frequency antenna for receiving signals of a first frequency and a second frequency, disposed in a three-dimensional space having a first surface, a second surface, a third surface, and a fourth surface, with the second surface roughly perpendicular to the first surface, the third surface roughly parallel to the second surface and perpendicular to the first surface, the fourth surface roughly parallel to the first surface and roughly perpendicular to the second surface and the third surface, the multi-frequency antenna comprising:

a grounding element, which is disposed on the first surface;

a first conductive member, which has a conductive component and a ground connecting component, the ground connecting component being disposed on the second surface with one edge connecting to the conductive component and the other end connecting to the grounding element;

a first radiation member, which receives signals of the first frequency and connects to the conductive component, the first radiation member being distributed over the second surface and the third surface; and a second radiation member, which receives signals of the second frequency and connects to the conductive component at a predetermined distance from the first radiation member, the second radiation member being distributed over the second, third, and fourth surfaces.

17. The multi-frequency antenna of claim 16, wherein the first radiation member includes a first radiation body and a first connecting part, the first radiation body being distributed over the second surface and the third surface and connecting to the conductive component, the first connecting part being distributed over the second surface with one end connecting to the ground connecting component via a first connecting point and the other end having a ladder-shaped structure.

18. The multi-frequency antenna of claim 17 further comprising a passive element disposed on the first connecting part.

19. The multi-frequency antenna of claim 17, wherein the first connecting point is the signal feeding point of the first radiation member and the second radiation member.

20. The multi-frequency antenna of claim 17, wherein the second radiation member has a second radiation body on the fourth surface and connecting to the conductive component.

21. The multi-frequency antenna of claim 20, wherein the second radiation member further includes an L-shaped extension on the third surface, extending from the second radiation body toward the first radiation body, the L-shaped extension having a first extension on the second surface, extending toward the ladder-shaped structure, having a shape corresponding to that of the ladder-shaped structure, and being separated from the ladder-shaped structure.

22. The multi-frequency antenna of claim 16 further comprising a parasitic structure on the fourth surface, extending from the third surface to the second surface, for increasing the frequency response of the second radiation member.

23. The multi-frequency antenna of claim 22, wherein the parasitic structure has a ground connecting part connecting to the grounding element.

24. The multi-frequency antenna of claim 23, wherein the ground connecting part further includes a second conductive member extending out from the ground connecting part.

25. The multi-frequency antenna of claim 24, wherein the first extension further includes a third radiation member connecting to the second conductive member via a second connecting point.

26. The multi-frequency antenna of claim 25, wherein the second connecting point is the signal feeding point of the third radiation member.

27. The multi-frequency antenna of claim 26, wherein the third radiation member includes a first portion disposed on the fourth surface for receiving signals of a third frequency.

28. The multi-frequency antenna of claim 27, wherein the third radiation member includes a second portion disposed on the second surface for receiving signals of a fourth frequency, and the first portion and the second portion connect to the second conductive member via a third conductive member.

29. The multi-frequency antenna of claim 16 made of a metal material.

30. The multi-frequency antenna of claim 16 made of a soft printed circuit.

* * * * *